US011974665B2

(12) United States Patent
James et al.

(10) Patent No.: US 11,974,665 B2
(45) Date of Patent: May 7, 2024

(54) SPORTS BALL RACK WITH ADJUSTABLE ROWS

(71) Applicant: MURRAY SPORTING GOODS, LLC, Murray, KY (US)

(72) Inventors: Janson James, Murray, KY (US); Jeffrey George, Chicago, IL (US)

(73) Assignee: MURRAY SPORTING GOODS, LLC, Murray, KY (US)

( * ) Notice: Subject to any disclaimer, the term of this patent is extended or adjusted under 35 U.S.C. 154(b) by 0 days.

(21) Appl. No.: 17/752,085

(22) Filed: May 24, 2022

(65) Prior Publication Data

US 2023/0380589 A1 Nov. 30, 2023

(51) Int. Cl.
*A47B 81/00* (2006.01)
*A63B 47/00* (2006.01)

(52) U.S. Cl.
CPC ..... *A47B 81/00* (2013.01); *A63B 47/00* (2013.01)

(58) Field of Classification Search
CPC ..... A47B 81/00; A47B 81/007; A47B 57/04; A63B 47/00
USPC ..... 211/14, 15, 85.7
See application file for complete search history.

(56) References Cited

U.S. PATENT DOCUMENTS 221,945 A * 11/1879 Stitzel ..... A47B 81/007 211/85.22
288,675 A * 11/1883 Spangler ..... A63D 15/00 211/15
295,857 A * 3/1884 Collender ..... A63D 15/00 211/15
297,031 A * 4/1884 Tea ..... A63D 15/00 211/99
892,290 A * 6/1908 McGovney ..... A63D 15/00 211/15
1,113,183 A * 10/1914 Baehn ..... A47B 57/04 108/1
1,438,729 A * 12/1922 Vance ..... A47F 7/04 211/23
1,733,487 A * 10/1929 Lavant ..... A47B 61/04 211/35
1,927,997 A * 9/1933 Turner ..... A47F 7/08 211/38
1,951,894 A * 3/1934 Ziebarth ..... A47F 7/0028 473/410
1,995,383 A * 3/1935 Fischer ..... A47B 61/04 D6/678.4
2,431,423 A * 11/1947 Robbins ..... A47B 45/00 211/175
D164,503 S * 9/1951 Kerr ..... D6/552
3,120,199 A * 2/1964 Kolster ..... A47B 96/025 108/6

(Continued)

FOREIGN PATENT DOCUMENTS

CA 2573846 A1 * 7/2007 ..... A47B 81/007
FR 1376722 A * 10/1964

*Primary Examiner* — Stanton L Krycinski
(74) *Attorney, Agent, or Firm* — Lewis Roca Rothgerber Christie, LLP

(57) ABSTRACT

A ball rack including one or more rows; and a plurality of side panels, wherein ends of the one or more rows are connected to the plurality of side panels, wherein at least one row of the one or more rows is an adjustable row, and wherein at least one end of the adjustable row is adjustably connected to a first side panel of the plurality of side panels by an adjustable mechanism.

22 Claims, 3 Drawing Sheets

(56) References Cited

U.S. PATENT DOCUMENTS 3,132,609 A * 5/1964 Chesley ..... A47B 57/54 108/189
3,348,698 A * 10/1967 Mcconnell ..... A47F 7/04 211/24
3,355,027 A * 11/1967 Gibbons ..... A63B 47/00 190/18 R
3,557,966 A * 1/1971 Skubic ..... A47B 81/007 211/24
3,888,353 A * 6/1975 Leifheit ..... A47B 61/04 211/37
4,282,977 A * 8/1981 Di Lorenzo ..... F16B 12/18 211/74
4,383,722 A * 5/1983 Weber ..... A47B 57/04 312/133
4,531,646 A * 7/1985 Howard ..... A47F 5/12 D6/675.4
D290,201 S * 6/1987 Wilder ..... D6/675.4
4,836,391 A * 6/1989 Bell ..... A47B 81/007 211/60.1
4,854,456 A * 8/1989 Lee ..... A47B 81/007 211/175
4,896,778 A * 1/1990 Ferdinand ..... A47F 7/08 D6/672
4,936,467 A * 6/1990 Bobeczko ..... A47F 7/00 211/175
D313,715 S * 1/1991 Ohno ..... D6/552
5,027,962 A * 7/1991 Maccarrone ..... A47B 57/04 211/182
5,172,816 A * 12/1992 Kline ..... A47F 7/08 211/37
D365,716 S * 1/1996 Rose, Sr. ..... D6/552
5,617,959 A * 4/1997 Klein ..... A47F 7/08 211/37
5,749,480 A * 5/1998 Wood ..... A47B 57/04 248/242
5,871,105 A * 2/1999 Whitehead ..... A63B 71/0045 211/14
5,913,432 A * 6/1999 Ahrens ..... E01F 13/022 211/206
5,931,483 A * 8/1999 Haynes ..... B62B 1/262 280/47.35
5,992,647 A * 11/1999 Malik ..... G11B 23/0236 211/40
6,138,841 A * 10/2000 Klein ..... A47G 25/10 D6/552
6,247,602 B1 * 6/2001 Klein ..... F16B 12/42 211/189
6,253,687 B1 * 7/2001 McAllister ..... A47B 57/545 108/107
6,364,129 B1 * 4/2002 Dardashti ..... G11B 23/0236 211/41.12
6,431,090 B1 * 8/2002 Davis ..... A47B 57/04 108/107
6,786,337 B2 * 9/2004 Klein ..... A47F 5/01 211/189
7,000,787 B2 * 2/2006 Felsenthal ..... A47F 5/137 211/175
7,249,679 B2 * 7/2007 Klein ..... A47F 7/08 211/175
7,249,680 B2 * 7/2007 Wang ..... A47B 96/024 211/36
8,167,148 B2 * 5/2012 Jacobson ..... G10G 5/00 108/193
8,636,156 B2 * 1/2014 Malik ..... A47B 57/04 211/90.03
8,900,074 B1 * 12/2014 Johnson ..... A63B 71/0036 473/422
8,919,577 B2 * 12/2014 Nally ..... A63B 47/007 211/85.7
9,078,516 B2 * 7/2015 Vogel ..... A47B 73/00
9,936,825 B1 * 4/2018 Lindblom ..... A47F 5/0087
10,576,322 B2 * 3/2020 Schlegel ..... A63B 22/20
10,926,151 B2 * 2/2021 Dunahay ..... A63B 23/1218
11,457,735 B1 * 10/2022 D'Isep ..... A47B 57/045
11,464,330 B2 * 10/2022 Felsenthal ..... A47B 57/04
11,470,960 B2 * 10/2022 Brown ..... A47B 81/007
11,533,992 B2 * 12/2022 Payne ..... A47B 57/045
2004/0226903 A1 * 11/2004 Wang ..... A47B 57/04 211/187
2007/0051770 A1 * 3/2007 Berg ..... A47B 81/007 225/6
2007/0227989 A1 * 10/2007 Schneider ..... A47B 47/00 211/85.7
2008/0135509 A1 * 6/2008 Jackson ..... A47B 96/145 211/123
2009/0266777 A1 * 10/2009 Porter, Sr. ..... A47F 5/137 211/85.7
2012/0223041 A1 * 9/2012 Lee ..... A47B 57/04 29/525.08
2016/0106207 A1 * 4/2016 Wickett ..... A47B 57/04 211/175
2019/0098995 A1 * 4/2019 Brown ..... A47B 57/545
2021/0076818 A1 * 3/2021 Felsenthal ..... A47B 47/045

* cited by examiner

SPORTS BALL RACK WITH ADJUSTABLE ROWS

BACKGROUND

1. Field

Some embodiments of the present disclosure relate generally to a sports ball rack with adjustable rows.

2. Description of the Related Art

Various recreation centers store large numbers of sports balls, such as basketballs, volleyballs, or soccer balls, using various storage equipment. Some storage equipment includes a ball rack. Conventional ball racks may include one or more rows where the sports balls can be placed. Additionally, ball racks may also include casters that allow the ball rack to be moved to different locations. However, conventional balls racks do not provide much use beyond storage. Some modifications to the ball rack may allow for additional uses of the ball rack.

SUMMARY

Aspects of embodiments of the present disclosure are directed toward a sports ball rack with adjustable rows.

According to some example embodiments of the present disclosure, a ball rack including: one or more rows; and a plurality of side panels, wherein ends of the one or more rows are connected to the plurality of side panels, wherein at least one row of the one or more rows is an adjustable row, and wherein at least one end of the adjustable row is adjustably connected to a first side panel of the plurality of side panels by an adjustable mechanism.

According to some example embodiments, the adjustable mechanism is a push pin locking mechanism.

According to some example embodiments, the adjustable mechanism is configured to move along the first side panel from a first position to a second position, wherein the first and second positions are different distances from the ground.

According to some example embodiments, the at least one end of the adjustable row is at a first position and an opposite end of the adjustable row is at a second position, wherein the first and second positions are different distances from the ground.

According to some example embodiments, the one or more rows includes three rows.

According to some example embodiments, the adjustable row is a top row of the one or more rows.

According to some example embodiments, the adjustable row includes two bars that are configured to move independently from each other via the adjustable mechanism.

According to some example embodiments, the two bars are spaced apart from each other by a distance that is smaller than a diameter of a sports ball placed on the adjustable row.

According to some example embodiments of the present disclosure, the method includes: moving a first end of the adjustable row from a first position to a second position along a first side panel via a first adjustable mechanism, wherein the first and second positions are different distances from the ground, and wherein a second end of the adjustable row is connected to a second side panel at the first position.

According to some example embodiments, the first adjustable mechanism is a push pin locking mechanism.

According to some example embodiments, the second end is pivotally connected to the second side panel at the first position.

According to some example embodiments, the second end is adjustably connected to the second side panel via a second adjustable mechanism.

According to some example embodiments, the second adjustable mechanism is a push pin locking mechanism.

According to some example embodiments, the method further includes: moving the second end from the first position to the second position along the second side panel via the second adjustable mechanism.

According to some example embodiments, the ball rack includes one or more rows.

According to some example embodiments, the adjustable row is a top row of the one or more rows.

According to some example embodiments of the present disclosure, a ball rack including: one or more rows; and a plurality of side panels, wherein ends of the one or more rows are connected to the plurality of side panels, wherein at least one row of the one or more rows is an adjustable row, and wherein a first end of the adjustable row is adjustably connected to a first side panel of the plurality of side panels by an adjustable mechanism, and a second end of the adjustable row is pivotally connected to a second side panel of the plurality of side panel.

According to some example embodiments, the adjustable mechanism is push pin locking mechanism.

According to some example embodiments, the adjustable mechanism is configured to move along the first side panel from a first position to a second position, wherein the first and second positions are different distances from the ground.

According to some example embodiments, the first end of the adjustable row is at a first position and the second end of the adjustable row is at a second position, and wherein the first and second positions are different distances from the ground.

According to some example embodiments, the one or more rows include three rows.

According to some example embodiments, adjustable row is a top row of the one or more rows.

According to some example embodiments, the adjustable row includes two bars that are configured to move independently from each other via the adjustable mechanism.

According to some example embodiments, the two bars are spaced apart from each other by a distance that is smaller than a diameter of a sports ball placed on the adjustable row.

DETAILED DESCRIPTION

Figure 1:
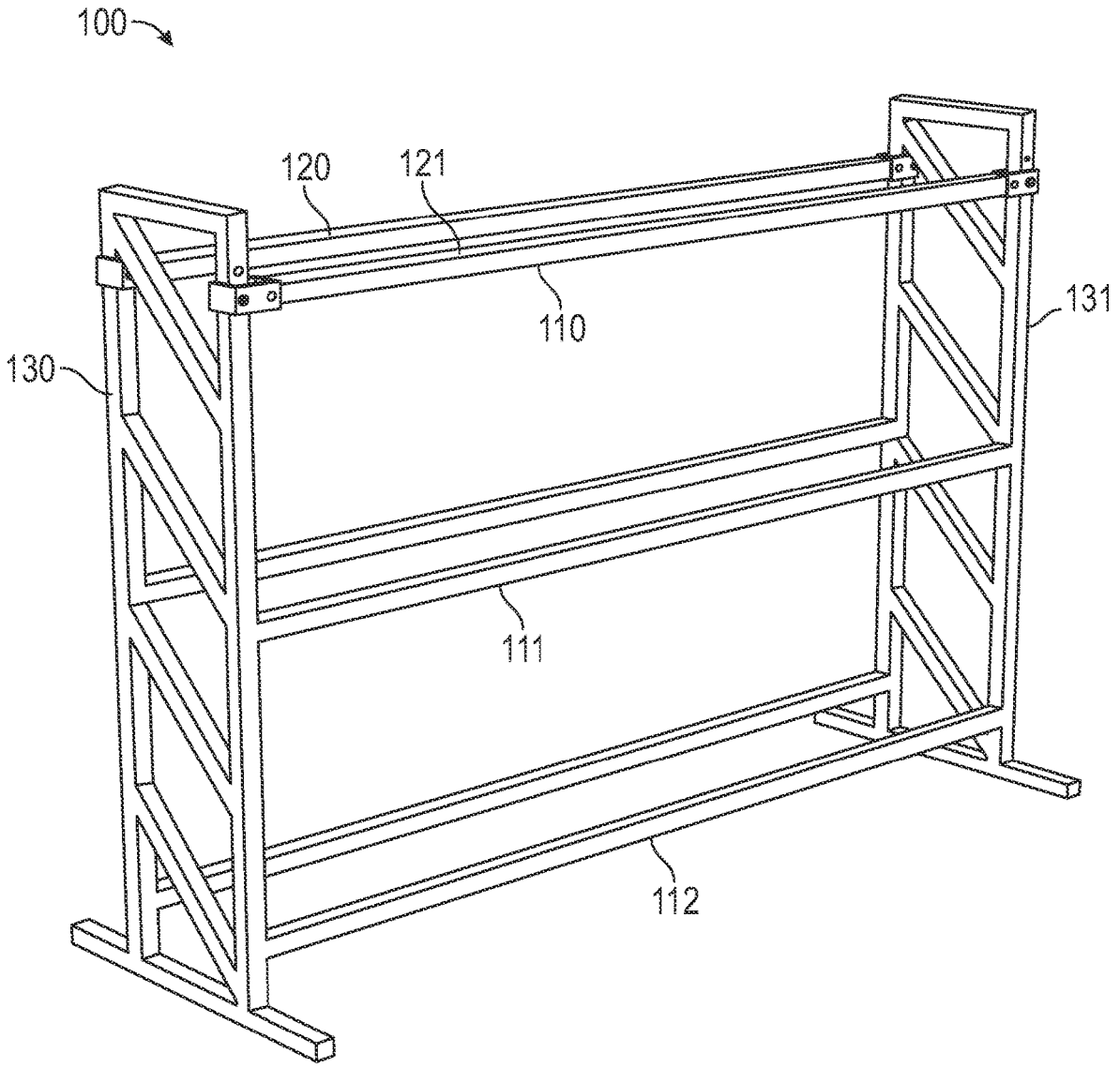
FIG. 1 is an image of a ball rack according to an embodiment of the present invention.

The exemplary embodiments of the present invention disclosed herein are generally related to a sports ball rack with adjustable rows.

Features of the inventive concept and methods of accomplishing the same may be understood more readily by reference to the following detailed description of embodiments and the accompanying drawings. Hereinafter, embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof will not be repeated. The drawings are not necessarily to scale and the relative sizes of elements, layers, and regions shown may be exaggerated for clarity.

Embodiments of the present disclosure include a ball rack for placing or storing sports balls. The sports balls may include various types of sports balls including, but not limited to, basketballs, volleyballs, and soccer balls. The ball rack may have one or more rows where the sports balls can be placed for storage. Each row of the one or more rows may be connected to a side panel on one end and connected to a separate side panel at an opposite end.

In some embodiments, one or more of the rows of the ball rack may be adjustable (e.g., an adjustable row). In some embodiments, the top row may be an adjustable row. The adjustable row can have ends that are adjustably connected (e.g., the ends are not connected in a fixed position) to the side panels. For example, each end of the adjustable row may be adjustably connected to the side panels via an adjustable mechanism. In some embodiments, the adjustable mechanism allows one or more rows to be adjusted by hand without the need for tools. The adjustable mechanism may be an adjustable mechanism for locking or otherwise holding a position along the side panels. For example, a push pin locking mechanism may be used. Such locking mechanisms are well-known, and can include spring-loaded push-pins, pull pins, or equivalent quick-release locking mechanisms. The adjustable mechanism can allow the ends of the adjustable row to be moved between one or more positions. For example, the ends may be moved from a first position to a second position or vice versa, where the second position is lower (e.g., closer distance to the ground) than the first position. In some embodiments, a height of the adjustable row may be adjusted by moving both ends of the adjustable row from a first position to a second position or vice versa, where the second position is lower (e.g., closer distance to the ground) than the first position. Additionally, in some embodiments, one end of the adjustable row may be adjustably connected to a side panel at a first position, while the opposite end of the adjustable row may be adjustably connected to the other side panel at a second position. This configuration allows the adjustable row to be at an angle (e.g., a slanted position or sloped position) that is no longer parallel to the ground. In some embodiments, the angle may range from about 1.5 to about 3.0 degrees with respect to the ground. The slanted position can allow gravity to pull the sports balls stored on the adjustable row toward the end that is adjustably connected at a position lower or closer to the ground. This can be advantageous for a user because the user can be provided a new sports ball without moving. For example, a user may be practicing free throws on a basketball court next to the ball rack with an adjustable row in a slanted position. The adjustable row may be full of basketballs and the basketballs will roll toward the user when the user removes the basketball closest to the user when shooting a free throw attempt. This will allow the user to receive a new ball for each free throw attempt without moving.

In some embodiments, the adjustable row may have a first end that is adjustably connected to a first side panel via an adjustable mechanism and a second end that is pivotally connected to second side panel. In some embodiments, the adjustable mechanism allows the first end of the adjustable row to be adjusted by hand without the need for tools. The adjustable mechanism may be an adjustable mechanism for locking or otherwise holding a position along the side panels. For example, a push pin locking mechanism may be used. Such locking mechanisms are well-known, and can include spring-loaded push-pins, pull pins, or equivalent quick-release locking mechanisms. The adjustable mechanism can allow the first end of the adjustable row to be moved between one or more positions. For example, the first end may be moved from a first position to a second position or vice versa, where the second position is lower (e.g., closer distance to the ground) than the first position. Additionally, in these embodiments, the second end is pivotally connected to the second side panel such that it can pivot at a fixed point on the second panel when the first end is moved between one or more positions. For example, the first end may be moved from a first position that is even with the second end (e.g., same distance from the ground) to a second position that is lower (e.g., closer distance to the ground) than the second end. In another example, the first end may be moved from a first position that is even with the second end (e.g., same distance from the ground) to a second position that is higher (e.g., further distance from the ground) than the second end. This configuration allows the adjustable row to be at an angle (e.g., a slanted position or sloped position) that is no longer parallel to the ground. In some embodiments, the angle may range from about 1.5 to about 3.0 degrees with respect to the ground. The slanted position can allow gravity to pull the sports balls stored on the adjustable row toward the end of the adjustable row that is positioned lower or closer to the ground.

FIG. 1 is an image of a ball rack according to an embodiment of the present invention.

Referring to FIG. 1, a ball rack 100 may be used to hold or store sports balls. The ball rack 100 may have one or more rows 110-112 where the sports balls can be placed or stored. In some embodiments, the ball rack 100 may have three rows, but other embodiments may include more or less rows. Each row 110-112 may be made up of one or more bars positioned adjacent to each other and parallel to the ground. In some embodiments, a single row may include two bars 120 and 121 positioned adjacent and parallel to each other and parallel to the ground. Further, the two bars 120, 121 are positioned the same distance from the ground. Additionally, the two bars 120, 121 may be positioned a distance from each other. In some embodiments, the distance may be less than the diameter of the sports ball 110 such that the sports ball can be positioned on top of the two bars 120 and 121 without falling to the ground. The ends of the bars 120, 121 of the rows may be connected to side panels 130 and 131 respectively.

In some embodiments, one or more of the rows 110-112 may be adjustable (e.g., an adjustable row). In some embodiments, the top row 110 may be an adjustable row. The adjustable row 110 can include bars 120 and 121 with ends that are adjustably connected (e.g., the ends are not connected in a fixed position) to the side panels 130, 131. For example, each end of the bars 120 and 121 of the adjustable row 110 may be adjustably connected to the side panels 130 and 131 via an adjustable mechanism. In some embodiments, the adjustable mechanism allows one or more rows to be adjusted by hand without the need for tools. The adjustable mechanism may be an adjustable mechanism for locking or otherwise holding a position along the side panels. For example, a push pin locking mechanism may be used. Such locking mechanisms are well-known, and can include spring-loaded push-pins, pull pin, or equivalent quick-release locking mechanisms. The adjustable mechanism can allow the ends of the bars 120 and 121 to be moved between the one or more positions. For example, the ends may be moved from a first position to a second position or vice versa, where the second position is lower (e.g., closer distance to the ground) than the first position. In some embodiments, a height of the adjustable row 110 may be adjusted by moving both ends of the bars 120 and 121 from a first position to a second position or vice versa, where the second position is lower (e.g., closer distance to the ground) than the first position. Additionally, in some embodiments, one end of a bar may be adjustably connected to a side panel at a first position, while the opposite end of the bar may be adjustably connected to the other side panel at a second position. For example, an end of the bar 120 may be connected to side panel 130 at a first position while the opposite end of the bar 120 may be connected to side panel 131 at a second position. This configuration allows the adjustable row 110 to be at an angle (e.g., a slanted position) that is no longer parallel to the ground. In some embodiments, the angle may range from about 1.5 to about 3.0 degrees with respect to the ground. The slanted position can allow gravity to pull the sports balls placed or stored on the adjustable row 110 toward the end that is positioned lower or closer to the ground.

In some embodiments, the adjustable row 110 may have a first end that is adjustably connected to side panel 131 via an adjustable mechanism and a second end that is pivotally connected to side panel 130. In some embodiments, the adjustable mechanism allows the first end of the adjustable row 110 to be adjusted by hand without the need for tools. The adjustable mechanism may be an adjustable mechanism for locking or otherwise holding a position along the side panels. For example, a push pin locking mechanism may be used. Such locking mechanisms are well-known, and can include spring-loaded push-pins, pull pins, or equivalent quick-release locking mechanisms. The adjustable mechanism can allow the first end of the adjustable row 110 to be moved between one or more positions along side panel 131. For example, the first end may be moved from a first position to a second position or vice versa, where the second position is lower (e.g., closer distance to the ground) than the first position. Additionally, in these embodiments, the second end is pivotally connected to the side panel 130 such that it can pivot at a fixed point on side panel 130 when the first end is moved between one or more positions along side panel 131. For example, the first end may be moved from a first position that is even with the second end (e.g., same distance from the ground) to a second position that is lower (e.g., closer distance to the ground) than the second end. In another example, the first end may be moved from a first position that is even with the second end (e.g., same distance from the ground) to a second position that is higher (e.g., further distance from the ground) than the second end. This configuration allows the adjustable row 110 to be at an angle (e.g., a slanted position or sloped position) that is no longer parallel to the ground. In some embodiments, the angle may range from about 1.5 to about 3.0 degrees with respect to the ground. The slanted position can allow gravity to pull the sports balls stored on the adjustable row 110 toward the end of the adjustable row 110 that is positioned lower or closer to the ground.

Figure 2:
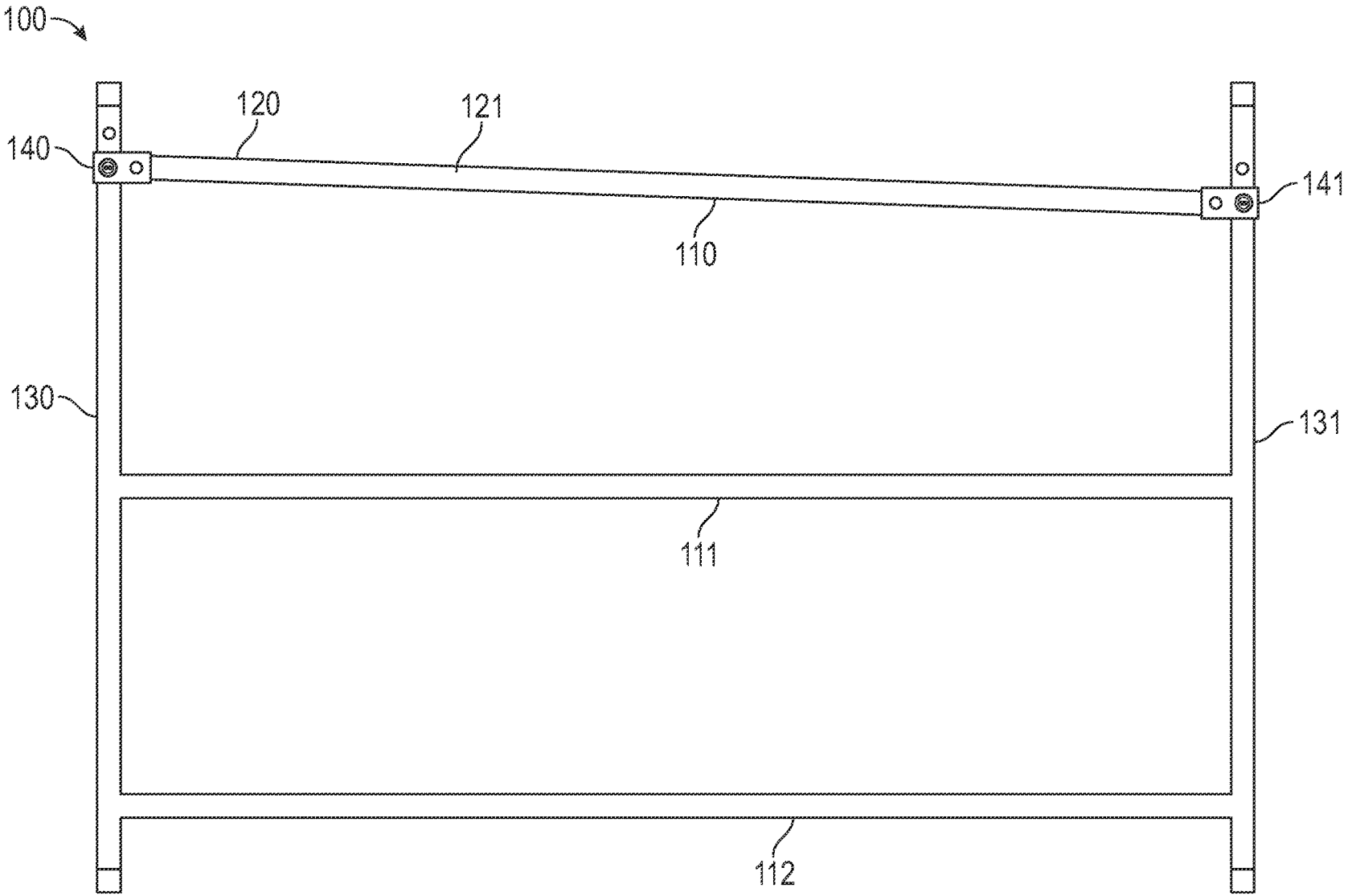
FIG. 2 shows a side view of the ball rack with the adjustable row in a slanted position according to an embodiment of the present invention.

FIG. 2 shows a side view of the ball rack with an adjustable row in a slanted position according to an embodiment of the present invention.

Referring to FIG. 2, one or more of the rows 110-112 of the ball rack 100 may be adjustable (e.g., an adjustable row). In some embodiments, the top row 110 may be an adjustable row. The adjustable row 110 may have ends 140 and 141 that are adjustably connected (e.g., the ends are not connected in a fixed position) to side panels 130 and 131 respectively. For example, the ends 140 and 141 of the adjustable row 110 may be adjustably connected to the side panels 130 and 131 respectively via adjustable mechanisms. The adjustable mechanisms may be adjustable mechanisms for locking or otherwise holding a position along the side panels. In some embodiments, the adjustable mechanism may be a push pin locking mechanism. Such locking mechanisms are well-known, and can include spring-loaded push-pins, pull pins, or equivalent quick-release locking mechanisms. The adjustable mechanism can allow the ends 140 and 141 to be moved between one or more positions. For example, the ends 140 and 141 may be moved from a first position to a second position or vice versa, where the second position is lower (e.g., closer distance to the ground) than the first position. In some embodiments, a height of the adjustable row 110 may be adjusted by moving both ends 140 and 141 from a first position to a second position or vice versa, where the second position is lower (e.g., closer distance to the ground) than the first position. Additionally, in some embodiments, one end of the adjustable row may be adjustably connected to a side panel at a first position, while the opposite end of the adjustable bar may be adjustably connected to the other side panel at a second position. For example, end 140 may be connected to side panel 130 at a first position while end 141 may be connected to side panel 131 at a second position. This configuration allows the adjustable row 110 to be at an angle (e.g., a slanted position) that is no longer parallel to the ground. In some embodiments, the angle may range from about 1.5 to about 3.0 degrees with respect to the ground. The slanted position can allow gravity to pull the sports balls placed or stored on the adjustable row 110 toward end 141 that is positioned lower or closer to the ground.

In some embodiments, the adjustable row 110 may have an end 141 that is adjustably connected to side panel 131 via an adjustable mechanism and an end 140 that is pivotally connected to side panel 130. In some embodiments, the adjustable mechanism allows end 141 to be adjusted by hand without the need for tools. The adjustable mechanism may be an adjustable mechanism for locking or otherwise holding a position along the side panels. For example, a push pin locking mechanism may be used. Such locking mechanisms are well-known, and can include spring-loaded push-pins, pull pins, or equivalent quick-release locking mechanisms. The adjustable mechanism can allow end 141 to be moved between one or more positions along side panel 131. For example, end 141 may be moved from a first position to a second position or vice versa, where the second position is lower (e.g., closer distance to the ground) than the first position. Additionally, in these embodiments, end 140 is pivotally connected to the side panel 130 such that it can pivot at a fixed point on side panel 130 when end 141 is moved between one or more positions along side panel 131. For example, end 141 may be moved from a first position that is even with end 140 (e.g., same distance from the ground) to a second position that is lower (e.g., closer distance to the ground) than end 141. In another example, end 141 may be moved from a first position that is even with end 140 (e.g., same distance from the ground) to a second position that is higher (e.g., further distance from the ground) than end 140. This configuration allows the adjustable row 110 to be at an angle (e.g., a slanted position or sloped position) that is no longer parallel to the ground. In some embodiments, the angle may range from about 1.5 to about 3.0 degrees with respect to the ground. The slanted position can allow gravity to pull the sports balls stored on the adjustable row 110 toward the end of the adjustable row 110 that is positioned lower or closer to the ground.

Figure 3:
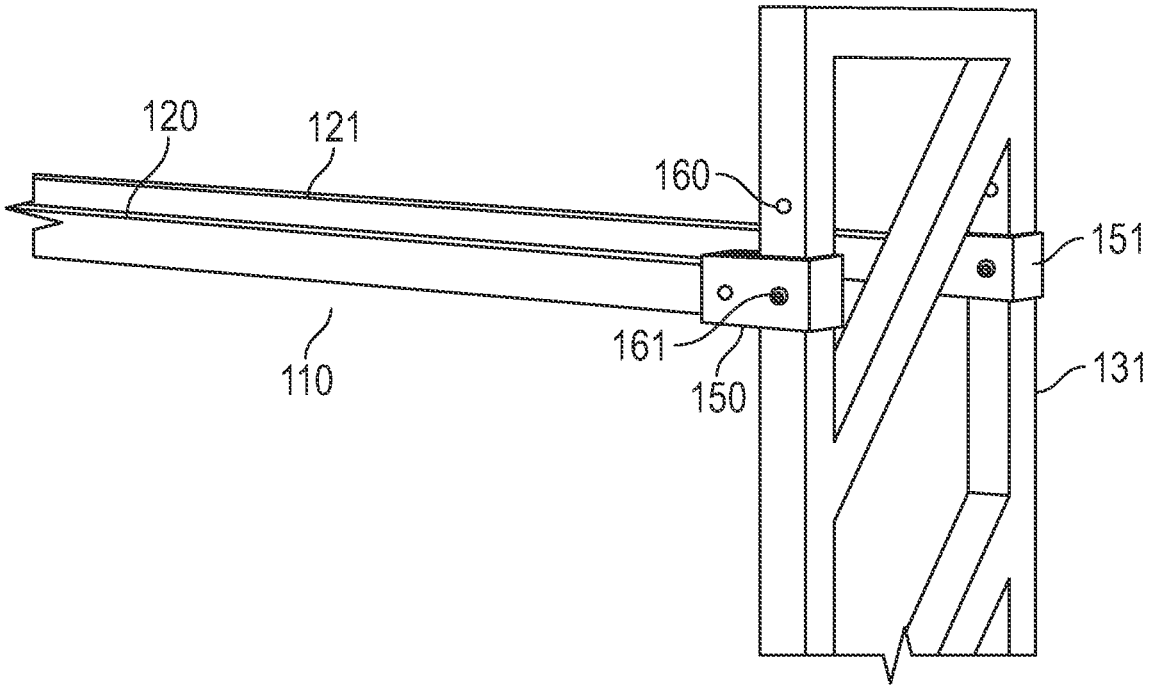
FIG. 3 shows an adjustable mechanism that connects the ends of the adjustable row to the side panels according to an embodiment of the present invention.

FIG. 3 shows an adjustable mechanism that connects ends of an adjustable row to the side panels according to an embodiment of the present invention.

Referring to FIG. 3, an adjustable row 110 can include bars 120 and 121 with ends that are adjustably connected (e.g., the ends are not connected in a fixed position) to the side panel 131. For example, an end of bar 120 may be connected to the side panel 130 via adjustable mechanism 150 and an end of bar 121 may be connected to the side panel 131 via adjustable mechanism 151. In some embodiments, the adjustable mechanisms 150 and 151 may be a push pin locking mechanism. Further, the adjustable mechanisms 150 and 151 can allow the ends of the bars 120 and 121 to be moved along side panel 131 between one or more positions. In some embodiments, the bars 120 and 121 may be connected at a first position 160 or at a second position 161, where the second position 161 is lower (e.g., closer distance to the ground) than the first position 160. Further, the bars 120 and 121 can be moved independent from each other. For example, the bar 120 may be moved to the first position 160, while the bar 121 is moved to the second position 161.

In the preceding description, for the purposes of explanation, numerous specific details are set forth to provide a thorough understanding of various embodiments. It is apparent, however, that various embodiments may be practiced without these specific details or with one or more equivalent arrangements.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Moreover, the drawings are not necessarily to scale.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A ball rack comprising:

one or more rows; and a plurality of side panels, wherein ends of the one or more rows are connected to the plurality of side panels, wherein at least one row of the one or more rows is an adjustable row, wherein at least a first end of the adjustable row is adapted to be adjustably connected to a first side panel of the plurality of side panels by a first adjustable mechanism adapted to permit the at least a first end of the adjustable row to move along the first side panel without disengaging from the first side panel, wherein at least a second end of the adjustable row opposite to the first end of the adjustable row is adapted to swivel at a second side panel of the plurality of side panels by a second adjustable mechanism when the at least first end of the adjustable row moves along the first side panel, and wherein the adjustable row comprises a first bar and a second bar, each of the first bar and the second bar is configured to move independently from each other and is configured to be at different angles from each other via the first adjustable mechanism and the second adjustable mechanism, each of the first bar and the second bar being extended from the first end to the second end of the adjustable row.

2. The ball rack of claim 1, wherein the first and second adjustable mechanisms are push pin locking mechanisms.

3. The ball rack of claim 1, wherein the first adjustable mechanism is configured to move along the first side panel from a first position to a second position, wherein the first and second positions are different distances from the ground.

4. The ball rack of claim 1, wherein the at least first end of the adjustable row is at a first position and the at least second end of the adjustable row is at a second position, wherein the first and second positions are different distances from the ground.

5. The ball rack of claim 1, wherein the one or more rows comprises three rows.

6. The ball rack of claim 1, wherein the adjustable row is a top row of the one or more rows.

7. The ball rack of claim 1, wherein the first bar and the second bar are spaced apart from each other by a distance that is smaller than a diameter of a sports ball placed on the adjustable row.

8. A method for adjusting an adjustable row of a ball rack, the method comprising:

moving a first end of the adjustable row from a first position to a second position along a first side panel via a first adjustable mechanism adapted to permit the first end of the adjustable row to move along the first side panel without disengaging from the first side panel, wherein the first and second positions are different distances from the ground, and wherein a second end of the adjustable row opposite to the first end of the adjustable row is connected to a second side panel at the first position and is adapted to swivel at the second side panel when the first end of the adjustable row moves from the first position to the second position along the first side panel, and wherein the adjustable row comprises a first bar and a second bar, each of the first bar and the second bar is configured to move independently from each other and is configured to be at different angles from each other via the adjustable mechanism, each of the first bar and the second bar being extended from the first end to the second end of the adjustable row.

9. The method of claim 8, wherein the first adjustable mechanism is a push pin locking mechanism.

10. The method of claim 8, wherein the second end is pivotally connected to the second side panel at the first position.

11. The method of claim 8, wherein the second end is adjustably connected to the second side panel via a second adjustable mechanism.

12. The method of claim 11, wherein the second adjustable mechanism is a push pin locking mechanism.

13. The method of claim 11, the method further comprising:

moving the second end from the first position to the second position along the second side panel via the second adjustable mechanism.

14. The method of claim 8, wherein the ball rack comprises one or more rows.

15. The method of claim 14, wherein the adjustable row is a top row of the one or more rows.

16. A ball rack comprising:

one or more rows; and a plurality of side panels, wherein ends of the one or more rows are connected to the plurality of side panels, wherein at least one row of the one or more rows is an adjustable row, wherein a first end of the adjustable row is adjustably connected to a first side panel of the plurality of side panels by an adjustable mechanism adapted to permit the first end of the adjustable row to move along the first side panel without disengaging from the first side panel, and a second end of the adjustable row is pivotally connected to a second side panel of the plurality of side panel, and the second end of the adjustable row is adapted to swivel at the second side panel when the first end of the adjustable row moves along the first side panel, and wherein the adjustable row comprises a first bar and a second bar, each of the first bar and the second bar is configured to move independently from each other and is configured to be at different angles from each other via the adjustable mechanism and, each of the first bar and the second bar being extended from the first end to the second end of the adjustable row.

17. The ball rack of claim 16, wherein the adjustable mechanism is push pin locking mechanism.

18. The ball rack of claim 16, wherein the adjustable mechanism is configured to move along the first side panel from a first position to a second position, wherein the first and second positions are different distances from the ground.

19. The ball rack of claim 16, wherein the first end of the adjustable row is at a first position and the second end of the adjustable row is at a second position, and wherein the first and second positions are different distances from the ground.

20. The ball rack of claim 16, wherein the one or more rows comprise three rows.

21. The ball rack of claim 16, wherein adjustable row is a top row of the one or more rows.

22. The ball rack of claim 16, wherein the first bar and the second bar are spaced apart from each other by a distance that is smaller than a diameter of a sports ball placed on the adjustable row.

* * * * *